US005158385A

United States Patent [19]

Fattori

[11] Patent Number: 5,158,385

[45] Date of Patent: Oct. 27, 1992

[54] SEALING CAP FOR ELONGATED ROLL-ON PACKAGE

[75] Inventor: Joseph E. Fattori, Mendham, N.J.

[73] Assignee: The Mennen Company, Morristown, N.J.

[21] Appl. No.: 606,487

[22] Filed: Oct. 31, 1990

Related U.S. Application Data

[62] Division of Ser. No. 331,856, Apr. 3, 1989, Pat. No. 4,984,921.

[51] Int. Cl.[5] ..... A45D 34/04; B65D 53/00

[52] U.S. Cl. ..... 401/213; 215/341; 215/343; 215/349; 220/304

[58] Field of Search ..... 220/255, 256, 304; 215/341, 343, 349, 350, 351; 401/213

[56] References Cited

U.S. PATENT DOCUMENTS

| | | | |
|---|---|---|---|
| 1,191,432 | 7/1916 | Jones | 220/256 |
| 2,228,056 | 1/1941 | Kazanjian | 220/256 |
| 2,602,565 | 7/1952 | Regan | 220/256 |
| 3,053,407 | 9/1962 | Lowen | 215/341 |
| 3,259,935 | 3/1962 | Miller . | |
| 3,385,968 | 5/1968 | Bryer | 220/256 X |
| 3,930,705 | 1/1976 | Gallagher . | |
| 4,030,844 | 6/1977 | Lench et al. . | |
| 4,168,128 | 9/1979 | Filmore et al. . | |
| 4,487,325 | 12/1984 | Willingham | 215/341 |
| 4,674,642 | 6/1987 | Towns et al. | 215/350 X |
| 4,720,019 | 1/1988 | Geiger | 215/343 |
| 4,744,481 | 5/1988 | Morgan, Jr. | 215/341 X |
| 4,844,269 | 7/1989 | Lucas | 215/341 X |

FOREIGN PATENT DOCUMENTS

| | | | |
|---|---|---|---|
| A10110113 | 10/1982 | European Pat. Off. . | |
| 519657 | 2/1931 | Fed. Rep. of Germany | 220/256 |
| 2573730 | 5/1986 | France . | |
| 522646 | 4/1955 | Italy | 215/341 |
| 272004 | 6/1927 | United Kingdom | 220/256 |
| 2053864 | 7/1979 | United Kingdom . | |

*Primary Examiner*—Steven A. Bratlie

*Attorney, Agent, or Firm*—Antonelli, Terry, Stout & Kraus

[57] ABSTRACT

A sealing cap, particularly for sealing against a non-circular sealing surface about an opening of a container (such as a wide roller type roll-on container), wherein the sealing gap includes a closure, a sealing member in the form of a non-circular gasket arranged within the closure for sealing against the non-circular sealing surface of the container, and an alignment disk in the closure for aligning the sealing gasket with the non-circular sealing surface during relative rotation of the sealing cap and container. The alignment disk and sealing gasket are rotatably supported within the closure. The alignment disk includes a non-cylindrical well for receiving the non-circular sealing surface of the container and a pair of opposed inclined surfaces for aligning the sealing gasket with the non-circular sealing surface during relative rotation of the container with the sealing cap. The alignment disc can be used in other applications than in a sealing cap, e.g., for aligning coupling surfaces of two members to be coupled, with one coupling surface being exposed in the non-cylindrical well and the other coupling surface being introduced into the alignment disc to be aligned with the first coupling surface.

29 Claims, 9 Drawing Sheets

SEALING CAP FOR ELONGATED ROLL-ON PACKAGE

This application is a Divisional application of application Ser. No. 07/331,856 filed Apr. 3, 1989, now U.S. Pat. No. 4,984,921.

DESCRIPTION

1. Technical Field

The present invention is directed to an improved sealing cap, particularly for sealing a non-circular opening of a container (e.g., where the container portion extending to the opening is non-cylindrical), and a package employing the sealing cap. More particularly, the invention is directed to an improved wide roller type roll-on package (for example, a deodorant or antiperspirant wide roller type roll-on package) and a sealing cap therefor.

2. Background Art

It is well known to provide screw closures for sealing articles having circular openings with the attendant ease of removal and replacement of the same. U.S. Pat. No. 4,030,844 to Lench, et al., for example, discloses a roll-on dispenser bottle assembly with a screw closure cap on a cylindrical bottle.

It is also desirable to provide a rotatable closure for sealing a container having a non-circular opening (for example, having a non-circular sealing surface) and wherein the container portion forming the opening is non-cylindrical. The patent to Miller, U.S. Pat. No. 3,259,935, discloses a closure retainer for a container having an elliptical opening with an ellipsoidal roller or applicator therein. The closure cap in Miller has an elliptical form corresponding to that of the upper end of the container so that it must be properly aligned with the container by the user before it can be inserted on the container. A rotatable, flexible and deformable ring with screw threads thereon is retained on the closure cap, and cooperates with screw threads provided on the non-circular, upper end of the container for securing the closure cap to the container after the closure cap has been inserted on the container. Such ring, due to its deformability and flexibility, can jump out of the track utilized for retaining the ring on the closure cap.

Thus, there is a need for a closure cap, particularly for containers having a non-circular opening (and having a non-circular sealing surface), which can easily and effectively seal a container opening (even if the opening is non-circular), and which is easy to manipulate and familiar to the consumer in its application.

DISCLOSURE OF INVENTION

An object of the present invention is to provide an improved sealing cap for sealing against a sealing surface of a container, including a container having a non-cylindrical upper end forming an opening to be sealed and having a non-circular sealing surface (including wherein the opening is non-circular); and to provide a package including a container and the improved sealing cap. In particular, an object of the present invention is to provide an improved sealing cap for sealing against a non-circular sealing surface of a container, which is easy to manipulate and which is familiar to the consumer in its operation (e.g., operates like a conventional screw closure for a container having a circular opening), and to provide an improved package including the sealing cap and container. More particularly, an object of the invention is to provide an improved sealing cap for sealing against a non-circular sealing surface extending about an opening of a container having a wide roller mounted in the opening, and to provide an improved package including the sealing cap and container having the wide roller. A further object is to provide a method of sealing a container using such improved sealing cap, particularly for sealing a container having a non-cylindrical portion extending to the opening to be sealed and having a non-circular sealing surface.

A further object of the invention is to provide an improved sealing cap; and to provide an improved package comprising a container, such as a container having a non-circular sealing surface, and a sealing cap for sealing against the sealing surface of the container, which enables the user to obtain a mechanical advantage in sealing the container in a simple, quick manner without concern for proper alignment of the sealing cap with the container. A further object is to provide a method of aligning a sealing surface of a container with a sealing member in such improved sealing cap.

A further object of the present invention is to provide means, and a method, for aligning coupling surfaces of respective members when coupling the members. In particular, an object of the present invention is to provide means, and a method, for aligning non-circular ends of respective members in coupling the members, particularly wherein the non-circular ends have the same shape.

These and other objects are attained by the improved sealing cap, of the present invention, for sealing against a sealing surface of a container (e.g., a non-circular sealing surface of a container). The sealing cap comprises a closure, sealing means arranged within the closure for sealing against the sealing surface of the container, and alignment means in the closure for aligning the sealing means with the sealing surface during application of the sealing cap to the container. Where the sealing surface is non-circular (e.g., a non-circular opening in the container), sealing means having a corresponding non-circular sealing surface can be arranged within the closure for sealing against the non-circular sealing surface, with alignment means aligning the sealing means and sealing surface as discussed above.

The sealing means can be fixed relative to the alignment means, and the alignment means and sealing means movable (e.g., rotatable) relative to the closure, to achieve the desired seal.

The above-referred-to alignment means can have other uses than as part of a sealing cap. Such alignment means can be used, generally, in coupling two members together (for example, for coupling two ends of respective cable portions). The alignment means can be positioned on one of the members, e.g., co-axially therewith and extending beyond the end of such member, with such alignment means being used to align the end of the other member to such member. In this aspect of the present invention the coupling surface of a first member corresponds to the sealing surface of the sealing means previously discussed, while the coupling surface of the second member, to be coupled to the first member, corresponds to the sealing surface of the container as previously discussed.

For example, the first member, whose coupling surface is exposed in the alignment means, can extend out the rear of the alignment means, while the coupling surface of the second member to be coupled is introduced into the front of the alignment means, to be guided into alignment with the coupling surface of the first member. Of importance to this aspect of the present invention is that the alignment means includes guiding means for guiding the coupling surface of the second member into alignment with the coupling surface of the first member. This aspect of the present invention has particular applicability where the coupling surfaces of the first and second members to be coupled are non-circular.

The package of the present invention includes a sealing cap (as described above) and a container (including a container having a non-circular opening to be sealed by the sealing cap, the container having a non-cylindrical portion extending to the opening). The container can include a conventional wide roller in the non-circular opening, to provide a wide roller type roll-on package.

In a disclosed, preferred embodiment of the invention the closure of the sealing cap has a lower open cylindrical end with an integrally formed, continuous screw thread provided on the inner surface thereof for mating with a cooperating, continuous screw thread of a cylindrical portion of a container to secure the closure on the container in a position where the sealing means seals against the sealing surface of the container. This arrangement provides the user with mechanical advantage in sealing a non-circular opening of a container in a simple, efficient manner without concern for alignment of the cooperating non-circular parts being engaged for effecting the seal.

The sealing means of the disclosed, preferred embodiment is a non-circular (that is, non-circular at least at the sealing edge) sealing gasket formed of compressible, resilient material. The alignment means is in the form of an alignment disk having a non-cylindrical well formed therein for receiving the non-circular sealing surface of the container. The sealing gasket is located within the well of the alignment disk in the closure.

The alignment disk and sealing gasket are rotatably supported within the closure so that the screw connection between the closure of the cap and the container can be effected with the cooperating non-circular parts remaining in alignment. For this purpose, illustratively an annular bead can be provided on the inner surface of the closure. The alignment disk is snap-fitted past the bead of the closure and is rotatably supported within the closure by the annular bead.

In the disclosed, preferred embodiment, the alignment disk is formed with a pair of opposed inclined surfaces for aligning (radially and axially aligning) the sealing gasket and well of the alignment disk with the sealing surface of the container during application of the sealing cap to the container. Once properly aligned, the cooperating threads on the sealing cap and the container are engaged and continued relative rotation between the sealing cap and container causes the sealing cap, including the alignment disc and gasket (sealing means), to be brought down into sealing engagement with the container sealing surface. Illustratively, the sealing gasket is compressed, by means of a projecting rib aligned with the sealing surface provided on the alignment disk, against the sealing surface of the container as the sealing surface moves deeper into the well of the alignment disk during relative rotation of the sealing cap and container.

The alignment disk and sealing gasket, as provided in the closure, illustratively are provided such that the sealing gasket extends into an opening in a recessed portion of the upper end of the closure and an adjacent opening on the center axis of the alignment disk. A flanged projection on the center axis of the upper end of the sealing gasket is secured within the opening in the alignment disk. An insert covers the recessed portion of the upper end of the closure.

A package according to a disclosed, preferred embodiment of the invention comprises a container with a non-circular opening and a non-circular sealing surface extending about the opening, and a removable sealing cap for sealing the opening of the container at the non-circular sealing surface.

In a further preferred embodiment of the invention, the package is a wide roller type roll-on package with the container having a wide roller rotatably mounted in an opening of the container for dispensing a liquid product including (but not limited to) an antiperspirant, deodorant or other cosmetic from the container. A non-circular sealing surface of the container extends about the opening and the wide roller, the edge of the gasket covering the gap between the edge of the container forming the opening and the wide roller. The removable sealing cap of the package permits closing the container opening at the non-circular sealing surface by covering the gap between the container and the wide roller with the gasket.

These and other objects, features and advantages of the present invention will become more apparent from the following description when taken in connection with the accompanying drawings, which show, for purposes of illustration only, two embodiments in accordance with the present invention.

BEST MODE FOR CARRYING OUT THE INVENTION

Figure 2:
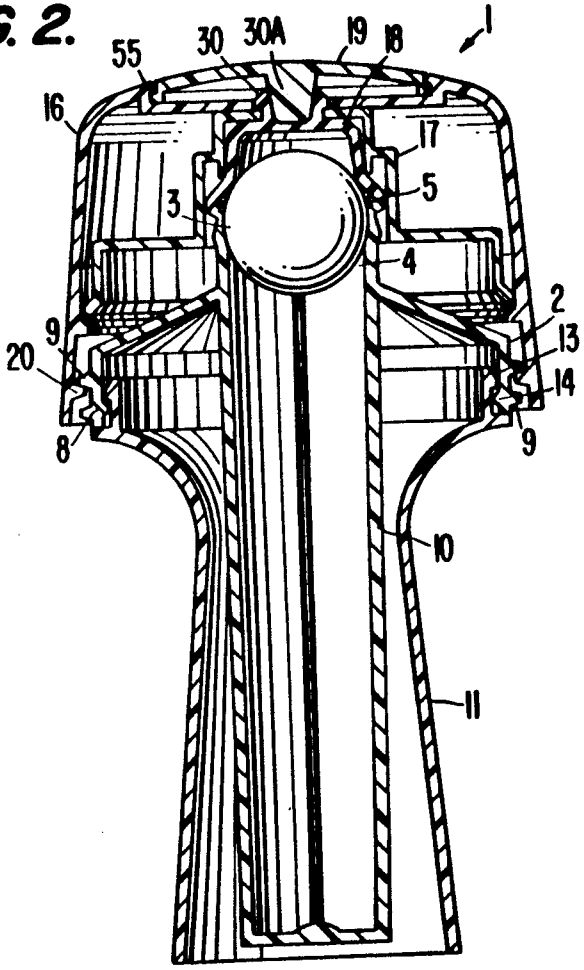
FIG. 2 is a cross-sectional view through the package of FIG. 1 taken at right angles to the cross section of FIG. 1 and perpendicular to the longitudinal axis of rotation of the roller.
Figure 1:
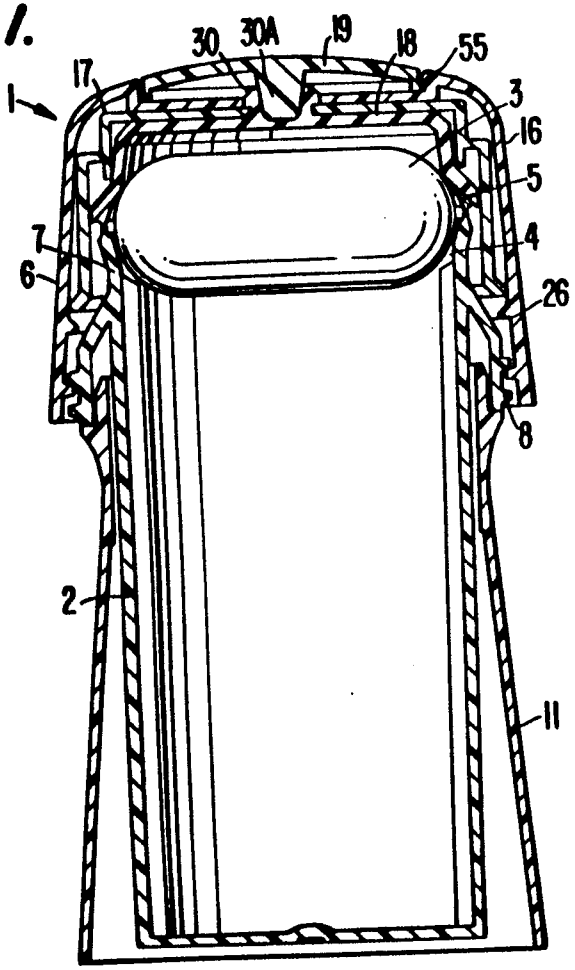
FIG. 1 is a cross-sectional view through a wide roller type roll-on package according to a first, preferred embodiment of the invention taken along the longitudinal axis of rotation of the roller and through the center of the package.
Figure 5:
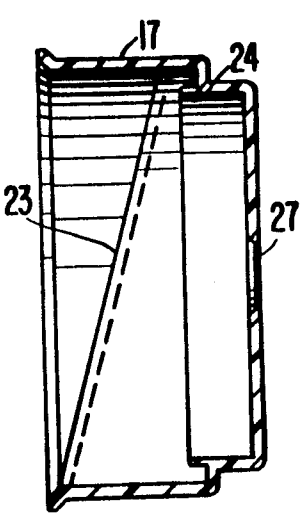
FIG. 5 is a cross-sectional view of the alignment disk taken along the line V—V in FIG. 3.
Figure 4:
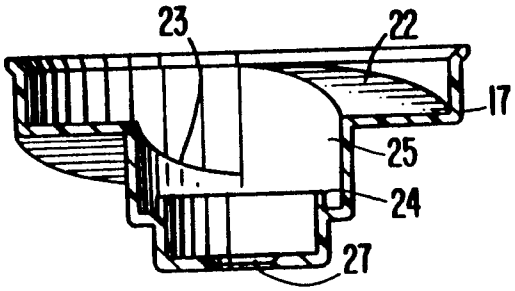
FIG. 4 is a cross-sectional view of the alignment disk taken along the line IV—IV in FIG. 3.
Figure 3:
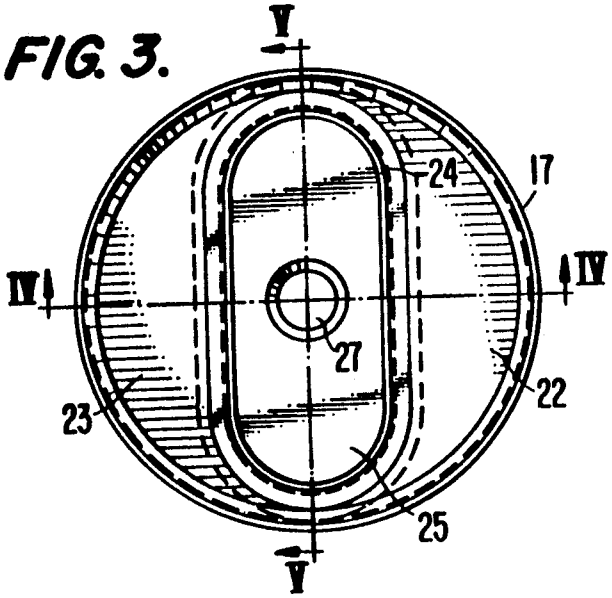
FIG. 3 is a bottom view of the alignment disk of the sealing cap employed in the package of FIG. 1.
Figure 6:
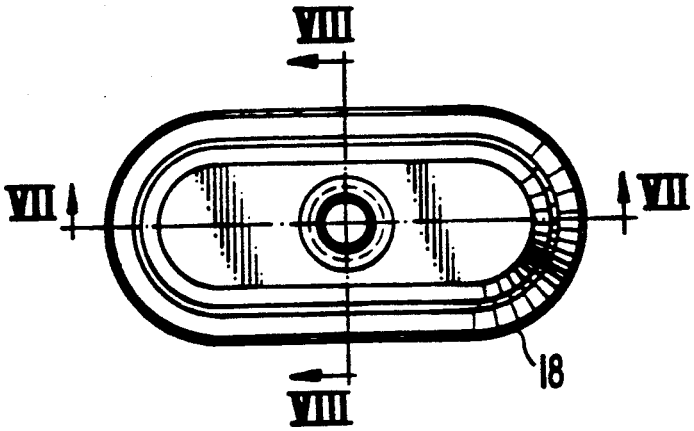
FIG. 6 is a top view of the sealing gasket of the sealing cap of the package of FIG. 1.
Figure 7:
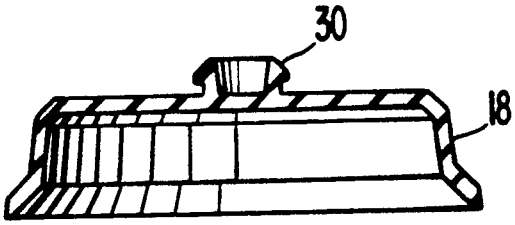
FIG. 7 is a cross-sectional view of the gasket taken along the line VII—VII in FIG. 6.
Figure 8:
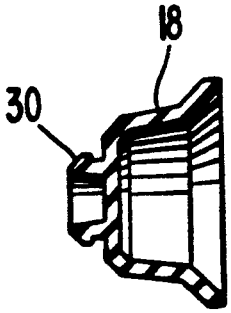
FIG. 8 is a cross-sectional view of the gasket taken along the line VIII—VIII in FIG. 6.
Figure 9:
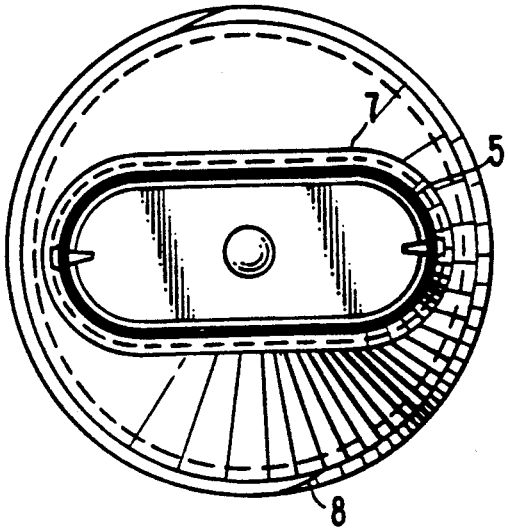
FIG. 9 is a top view of the container of the package of FIG. 1.

Referring now to the drawings, a package 1, according to a preferred embodiment of the invention, is a wide roller type roll-on package comprising a container 2 with a wide roller 3 mounted for rotation in an opening 4 at the upper end of the container, as shown in FIGS. 1 and 2. The wide roller 3 is used for dispensing a liquid such as an antiperspirant, deodorant or other cosmetic from the container. Such a wide roller, including its positioning in an opening in the upper end of the container, is conventional. A non-circular sealing surface 5 extends about the opening 4 and the wide roller 3 of the container 2. The oblong configuration of the sealing surface generally parallels that of the wide roller and of the end of the container forming the opening. The package 1 further comprises a removable sealing cap 6 for sealing the opening 4 of the container at the gap between the non-circular sealing surface 5 and the roller 3.

Figure 10:
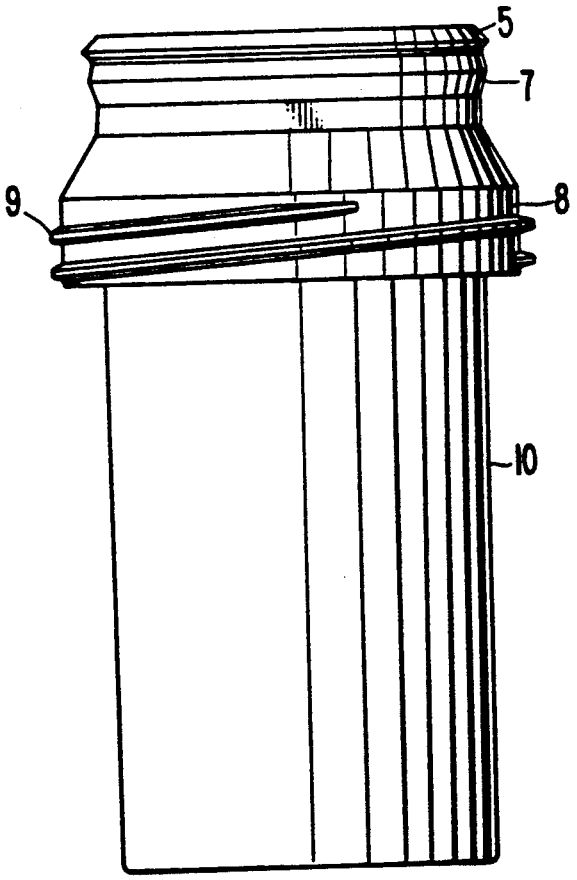
FIG. 10 is a side view of the container.
Figure 11:
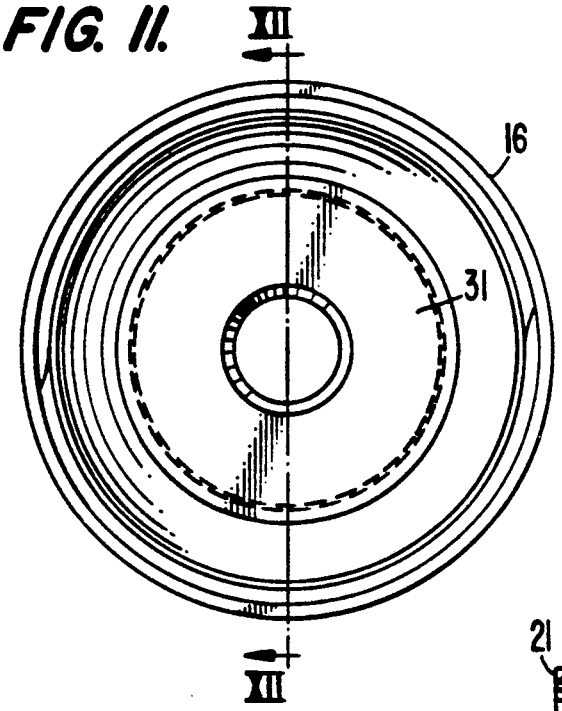
FIG. 11 is a bottom view of the closure of the sealing cap of the package of FIG. 1.
Figure 12:
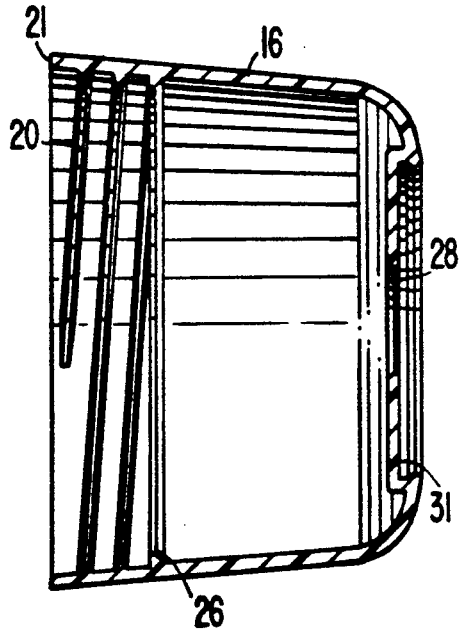
FIG. 12 is a cross-sectional view of the closure taken along the line XII—XII in FIG. 11.
Figure 13:
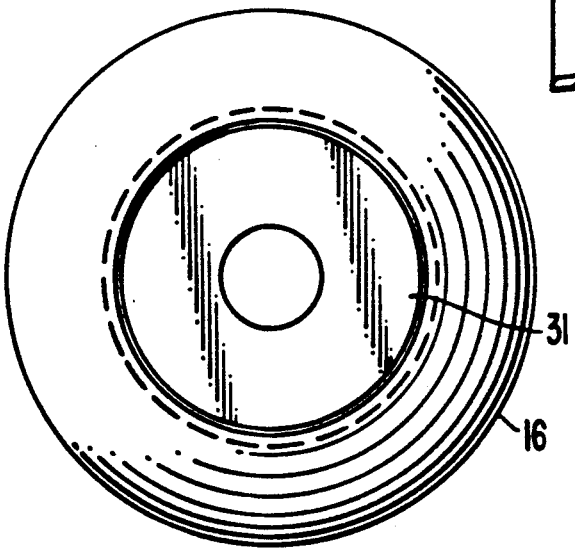
FIG. 13 is a top view of the closure.

The container 2 is preferably formed of a molded plastic, such as an injection molded ethylene-propylene copolymer. The container is formed with an oblong upper end 7 about the opening 4. The wide, oblong roller 3 is rotatably supported on its longitudinal axis within the opening 4 in a conventional manner, see FIG. 1. The oblong sealing surface 5 extends completely about the opening 4 and roller 3. A side portion 8 of the container 2 located below the upper end 7 has a cylindrical outer form. A continuous screw thread 9 is formed integrally with the container and extends around the cylindrical side portion 8, see FIG. 10.

A central, oblong body portion 10 of the container 2 holds the liquid to be dispensed from the package 1 by means of the wide roller 3. The liquid can be, illustratively, an antiperspirant, deodorant or other cosmetic, although other liquids could also be dispensed from the package. The liquid can be filled in the container as done conventionally, and used as done conventionally.

Other materials (e.g., powders) can also be dispensed from the container (that is, the present invention is not limited to liquid-containing packages). Moreover, the container need not include a roller (for example, the sealing means can seal an open top of a container, unobstructed by a roller or any other member).

A lower flared shell 11 as illustrated in FIGS. 1, 2 and 16–19, is provided on the container 2 for convenience in gripping the container 2 and for stability. The flared shell 11 is formed with a cylindrical top portion 12 which is snap-fitted into the interior of the cylindrical side portion 8 of the container 2 by means of cooperating projections 13 and 14 provided on the outer periphery at the upper end of the flared shell 11 and the inner periphery of the cylindrical side portion 8, respectively. The lower portion 15 of the flared shell 11 is oblong. The flared shell 11 is also preferably formed of molded plastic, as by injection molding. A polypropylene homopolymer plastic can be used for this purpose. The wide roller 3 of the container 2 is illustratively made of a high density polyethylene plastic.

Figure 20:
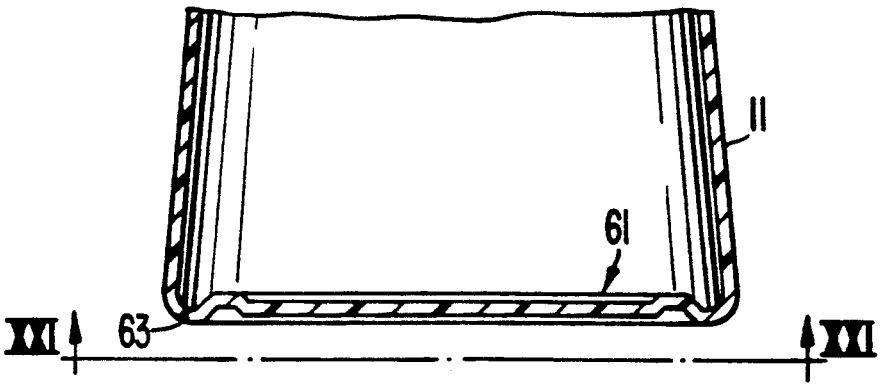
FIG. 20 is a cross-sectional view of an alternative embodiment for the bottom section of the flared shell.
Figure 21:
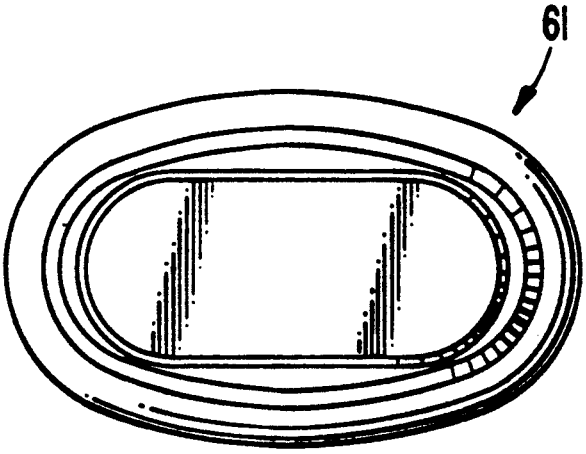
FIG. 21 is a bottom view of the alternative embodiment for the bottom section of the flared shell, along the line XXI—XXI in FIG. 20.

As seen in FIGS. 1, 2 and 16–19, the lower flared shell 11 has an open bottom. In a further embodiment of this flared shell 11, the bottom portion of which is shown in FIGS. 20 and 21, the lower flared shell 11 has a closed bottom 61, covering the bottom of the container 2. The closed bottom is recessed from the bottom edge 63 of the shell 11, so as to maintain stability of positioning the package in an upright position. The flared shell 11, having the closed bottom 61, can be formed of the materials discussed previously for the flared shell 11, and can be formed by conventional injection blow molding, as a single member.

The removable sealing cap 6 comprises a closure 16, an alignment disk 17, a sealing gasket 18 and an insert 19. The closure 16 as illustrated in FIGS. 1, 2 and 11–13 has an integrally formed continuous thread 20 at its lower open cylindrical end 21 which cooperates with mating thread 9 of the container 2. The continuous threads 9 and 20, when engaged, provide a mechanical advantage upon turning the sealing cap 6 relative to the container 2 for achieving sufficient downward force of the sealing cap 6 against the container 2 to seal the container 2. The cylindrical, threaded closing arrangement is also one which consumers are familiar with operating. The closure 16 transfers the downward motion and force to the alignment disk 17 which, in turn, biases the sealing gasket against the sealing surface of the container.

The alignment disk 17 contains opposing inclined surfaces 22 and 23, which are planar surfaces in the illustrated embodiment, and a continuous seal-effecting rib 24. A single, helical surface could be used, rather than opposing inclined surfaces, to provide alignment. The rib 24 is configured to match the non-circular sealing surface 5 of the container 2. Rather than (or in addition to) rib 24, the alignment disk 17 can include a portion (for example, extending from the top or side of the alignment disk) for engaging the sealing gasket 18 so as to effect the seal. Similarly to rib 24, the portion engaging the sealing gasket 18 would desirably be configured to match sealing surface 5, and would engage sealing gasket 18 to force it against sealing surface 5 and roller 3. The alignment disk 17 also is formed with an oblong alignment well 25 which, once engaged with the oblong upper end 7 of the container 2, aligns the sealing surface 5 of the container 2 with the seal-effecting rib 24 and the sealing gasket 18 retained within the alignment disk and prevents the alignment disk 17 and gasket 18 from rotating relative to the container. The alignment well 25 is sized relative to the container opening 4 and the sealing surface 5 to permit the sealing surface 5 and oblong upper end 7 of the container to be progressively inserted into the well during closing of the container. The alignment disk 17 is snapped into the closure 16 and is retained therein by annular bead 26 on the closure such that the alignment disk 17 is allowed to freely rotate about its axis relative to the closure.

The sealing gasket 18 is molded of a soft material such as rubber or a thermoplastic elastomer which is compressible, yet retains "memory". Illustratively, it is fastened to the inside of the alignment disk 17 by way of aligned opening 27 in the alignment disk 17, and an upstanding flanged projection 30 formed integrally with the sealing gasket 18 on the center axis thereof. The sealing gasket 18 bridges the gap between sealing surface 5 of the container 2 and wide roller 3 to seal the gap between the container and roller. The sealing gasket 18 covers the seal-effecting rib 24. Illustratively, the material of sealing gasket 18 has a Shore "A" hardness preferably within the range of 20–60. An example of one group of thermoplastic elastomers for the sealing gasket 18 is rubbery block copolymers, for example, those having styrene end blocks and isoprene midblock portions. Other suitable materials include liquid silicone rubbers and synthetic diene rubbers, for example.

Figure 14:
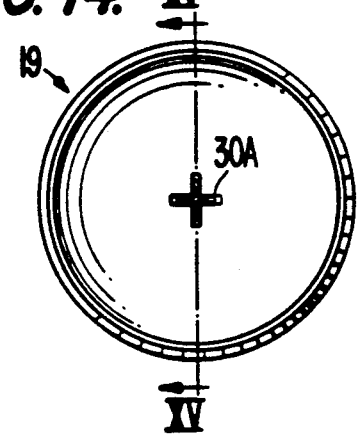
FIG. 14 is a bottom view of the insert of the sealing cap of the package of FIG. 1.
Figure 15:
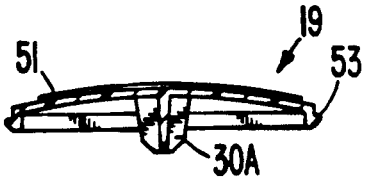
FIG. 15 is a cross-sectional view of the insert taken along the line XV—XV of FIG. 14.
Figure 16:
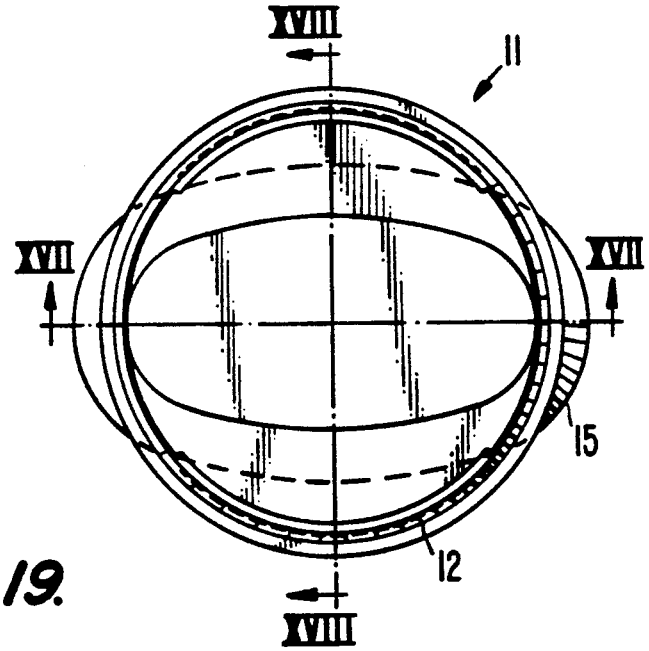
FIG. 16 is a top view of a flared shell, provided for stability, of the package of FIG. 1.
Figure 19:
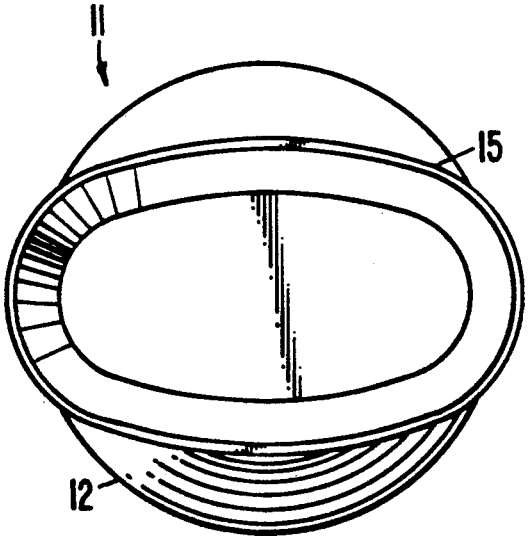
FIG. 19 is a bottom view of the flared shell.
Figure 18:
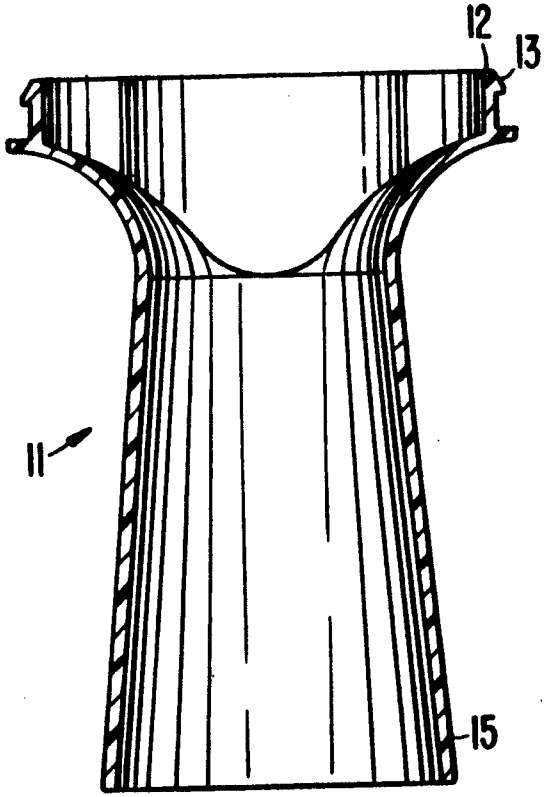
FIG. 18 is a cross-sectional view of the flared shell taken along the line XVIII—XVIII in FIG. 16.
Figure 17:
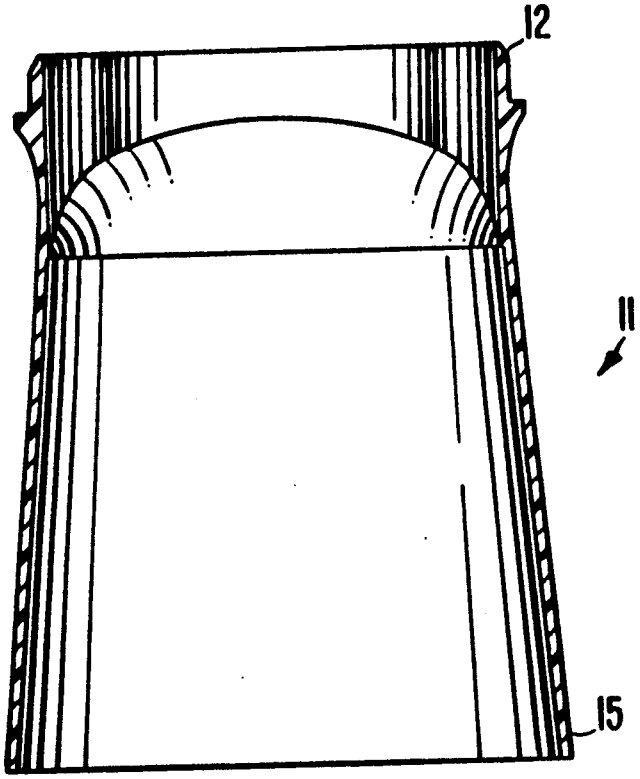
FIG. 17 is a cross-sectional view of the flared shell taken along the line XVII—XVII in FIG. 16.

Insert 19 is shown in more detail in FIGS. 14 and 15. Insert 19 has an upper surface 51 which, preferably, substantially continues the same line as the upper surface of closure 16 (see FIGS. 1 and 2). Insert 19 also preferably includes a central, downwardly extending projection 30A. The insert includes projection 53, which cooperates with projection 55 on the closure cap 16 such that the insert can be snap fit on the closure 16. Of course, other known means can be used for fastening the insert to the closure 16.

The closure 16, alignment disk 17 and insert 19 are each preferably formed by injection molding a polypropylene homopolymer. As shown in FIGS. 1 and 2, the central, downwardly extending projection 30A of insert 19 is received within a central opening of the flanged projection 30 of the sealing gasket 18 and within the openings 27, 28 in the disk 17 and closure 16, respectively, for covering a recessed portion 31 in the center of the upper end of the closure 16.

From the point of view of the consumer, opening and closing of the package 1 of the invention with the sealing cap 6 is like opening and closing any other continuous threaded closure. That is, to open the package 1, the closure 16 of the sealing cap 6 is rotated counterclockwise, and to close the package, the closure is rotated clockwise. During rotation of the closure, the sealing gasket 18 is aligned with the sealing surface 5.

More particularly, when the sealing cap 6 is placed on top of the container 2 to close the opening 4 of the container 2, the non-cylindrical upper end of the container 2 hits the opposing inclined planes 22 and 23 of the alignment disk 17, unless by chance it goes directly into the alignment well 25. The inclined planes 22 and 23 of the alignment disk 17 are spaced vertically to prevent the continuous threads 9 and 20 of the container 2 and the closure 16, respectively, from engaging one another when the non-cylindrical upper end 7 of the container 2 is against the opposing inclined planes 22 and 23. As the closure 16 is rotated clockwise about its axis in relation to the container 2, the opposing inclined planes 22 and 23, the angular position of which is consistent with clockwise rotation, guide the upper end 7 of the container 2 into the alignment well 25 which then prevents the alignment disk 17 from rotating relative to the container 2. Once the upper end 7 of the container 2 has engaged the alignment well 25, the vertical spacing now allows the continuous thread 20 of the closure 16 to engage the thread 9 of the container 2. As the closure 16 is continued to be rotated downward on the container 2, the sealing gasket 18 comes into contact with the sealing surface 5 and roller 3 and is compressed as the closure 16 transmits downward force to the alignment disk 17 and then to the seal-effecting rib 24. Thus, the alignment disk, which rotates the sealing gasket (radially moves the sealing gasket 18) relative to the upper end 7 of the container 2 until the upper end 7 enters the alignment well 25, and prevents relative rotation between the upper end 7 and alignment well 25 after the upper end 7 enters the well 25 while the sealing gasket 18 is compressed against (moves axially against) the sealing surface 5, both radially and axially aligns the sealing gasket 18 and sealing surface 5. To open the container 2, the closure 16 is rotated counterclockwise and as soon as the thread 20 disengages the container thread 9, the closure 16 and the remaining structure of the removable cap 6 are lifted off.

Figure 23:
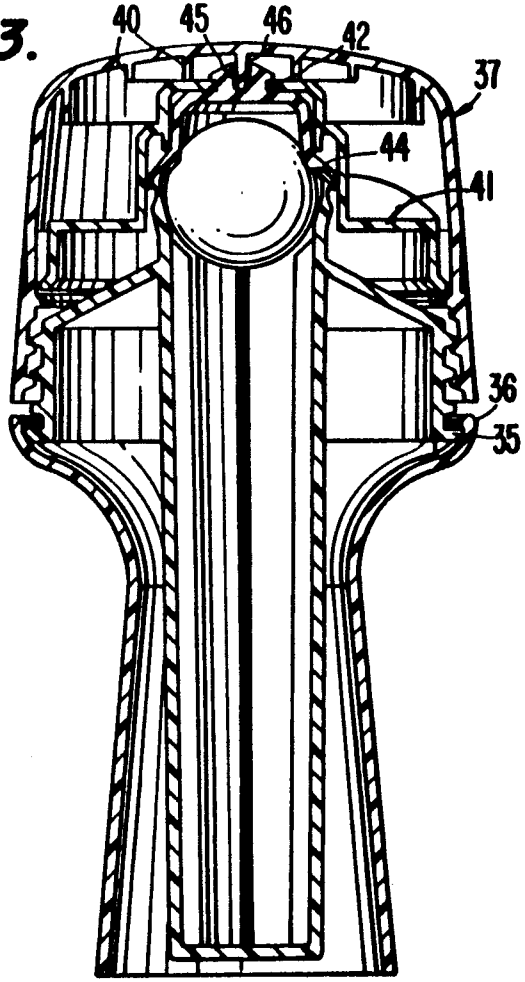
FIG. 23 is a cross-sectional view through the package of FIG. 22 taken at right angles to the cross-section of FIG. 22 and perpendicular to the longitudinal axis of rotation of the roller.
Figure 22:
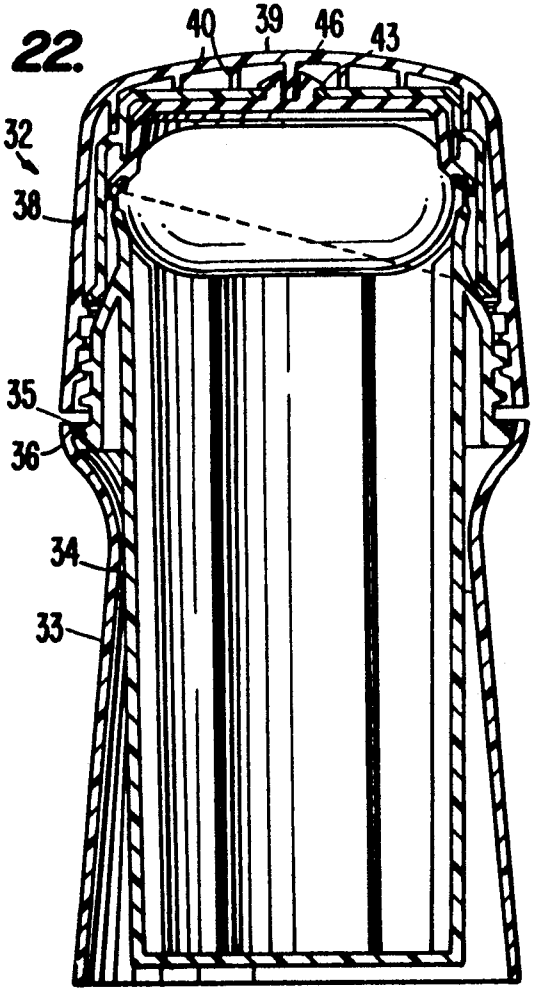
FIG. 22 is a cross-sectional view through a wide roller type roll-on package according to a second embodiment of the invention taken along the longitudinal axis of rotation of the roller and through the center of the package.

According to the second form of the invention illustrated in FIGS. 22 and 23 of the drawings, a wide roller type roll-on package 32 is similar to the package 1 illustrated in the first embodiment except that the flared shell 33 provided on the container 34 is snap-fitted onto the exterior of the cylindrical side portion of the container by means of cooperating projections 35 and 36.

The removable sealing cap 37 of the package 32 also differs from that in the first embodiment. The sealing cap 37 does not include an annular recess at the upper, outer end of the closure thereof or an insert as in the sealing cap 6 of package 1. Rather, the closure 38 of the sealing cap is closed at its upper end 39. The closure 38 includes annular ribs 40 which depend downwardly from the inner surface of the upper end 39 of closure 38 for transferring downward motion and force to the alignment disk 41.

The alignment disk is snap fitted into the closure 38 in a manner which permits relative rotation of the alignment disk with respect to the closure in the same manner as discussed above with respect to the first embodiment. The alignment disk 41 includes a central opening 42 in its upper end for receiving a flanged projection 43 of sealing gasket 44 to retain the sealing gasket within the alignment disk. The flanged projection 43 has an upwardly open, central aperture 45 which receives a central projection 46 on the closure 38 to maintain alignment between the sealing gasket and closure while permitting relative rotation of the two. Materials of components of the package 32 of the embodiment shown in FIGS. 22 and 23 can be the same as that of the corresponding components in the first embodiment.

While I have shown and described only several embodiments in accordance with the present invention, it is understood that the same is not limited thereto, but is susceptible to numerous changes and modifications as known to those skilled in the art. For example, although the package 1 of the preferred embodiment is designed specifically for a wide roller type roll-on package, the invention could also be applied to sealing other containers in which the opening is non-circular or wherein at least a non-circular sealing surface is present. Therefore, I do not wish to be limited to the details shown and described herein, but intend to cover all such changes and modifications as are encompassed by the scope of the appended claims.

I claim:

1. A sealing cap for sealing against a sealing surface of a container, said sealing cap comprising a closure, a sealing member which is arranged within the closure for sealing against a sealing surface of the container, and an alignment member in said closure which aligns the sealing member radially with the sealing surface when the sealing cap is placed over the sealing surface of the container and rotated relative to said sealing surface.

2. The sealing cap according to claim 1, wherein said sealing surface of the container is non-circular.

3. The sealing cap according to claim 2, wherein the closure has a lower open cylindrical end for receiving said non-circular sealing surface.

4. The sealing cap according to claim 3, wherein a screw thread is provided on the open cylindrical end of the closure for mating with a cooperating screw thread on a cylindrical portion of the container to secure the sealing cap on the container in a position where the sealing member seals against the non-circular sealing surface of the container.

5. The sealing cap according to claim 2, wherein the sealing member is formed of a compressible, resilient material having a Shore "A" hardness within the range 20 to 60.

6. The sealing cap according to claim 2, wherein said alignment member includes a non-cylindrical well formed in said sealing cap for receiving the non-circular sealing surface of the container, said sealing member being located within said well of the alignment member in the closure.

7. The sealing cap according to claim 2, wherein said alignment member contains at least one inclined surface for engaging the container for aligning the sealing member with the non-circular sealing surface of the container during relative rotation between the sealing cap and sealing surface.

8. The sealing cap according to claim 7, wherein the alignment member contains a pair of opposed inclined surfaces for aligning the sealing member with the non-circular sealing surface of the container.

9. The sealing cap according to claim 7, wherein the alignment member comprises a portion for engaging the sealing member to force it against the non-circular sealing surface of the container.

10. The sealing cap according to claim 1, further comprising a support which rotatably supports the alignment member and sealing member within the closure.

11. The sealing cap according to claim 10, wherein said support includes an annular bead on the inner surface of said closure, the alignment member being snap fitted past the bead and rotatably supported within the closure by said annular bead.

12. The sealing cap according to claim 10, wherein the alignment member has an opening in an upper end thereof, on the center axis thereof, and an upper end of the sealing member has a flanged projection on a center axis thereof, the flanged projection being secured within the opening in the alignment member.

13. The sealing cap according to claim 12, wherein an upper end of the closure is also provided with an opening adjacent the opening in the alignment member, the opening in the closure being in a recessed portion thereof, and wherein an insert covers the recessed portion of the upper end of the closure.

14. The sealing cap according to claim 1, wherein the alignment member is retained in said closure so as to be able to rotate relative to said closure.

15. The sealing cap according to claim 1, wherein the sealing member is fixed relative to the alignment member, and the alignment member and sealing member are movable relative to the closure.

16. The sealing cap according to claim 1, wherein the alignment member is an alignment disk rotatably secured within the closure.

17. The sealing cap according to claim 1, wherein both the sealing member and alignment member are rotatable relative to the closure.

18. The sealing cap according to claim 1, wherein the alignment member aligns the sealing member both radially and axially with the sealing surface when the sealing cap is placed over the sealing surface of the container and rotated relative to said sealing surface.

19. A sealing cap adapted for use in a wide roller type roll-on package comprising a container having a non-circular sealing surface extending about a wide roller of the container, the sealing cap comprising (1) a closure having a lower open cylindrical end with a screw thread formed integrally therewith for mating engagement with a cooperating screw thread of a cylindrical portion of the container to secure the sealing cap to the container with relative rotation of the sealing cap and container, (2) an alignment disk rotatably secured within the closure, and (3) a sealing member arranged within the alignment disk for sealing against the non-circular sealing surface of the container when said sealing cap is screwed onto the container, said alignment disk aligning the sealing member radially with the non-circular sealing surface.

20. The sealing cap according to claim 19, wherein said alignment disk has a non-cylindrical well formed therein for receiving the wide roller of the container and the non-circular sealing surface extending about the wide roller.

21. The sealing cap according to claim 20, wherein said alignment disk further includes at least one inclined surface for aligning the wide roller and the non-circular sealing surface of the container with the well of the alignment disk during relative rotation for insertion of the wide roller and the non-circular sealing surface into the well whereby the respective screw thread are in mating engagement for screwing of the sealing cap on the container.

22. The sealing cap according to claim 19, wherein the alignment disk aligns the sealing member both radially and axially with the sealing surface when the sealing cap is placed over the sealing surface of the container and rotated relative to said sealing surface.

23. A package comprising a container with an opening and a non-circular sealing surface extending about the opening, and a removable sealing cap for closing the opening of the container, the sealing cap comprising a closure, a sealing member arranged within the closure for sealing against the non-circular sealing surface of the container, and a alignment means member in the closure which aligns the sealing means radially with the sealing surface.

24. A method of aligning a sealing cap for sealing against a sealing surface of a container, comprising the steps of providing a sealing cap including a closure, a sealing member arranged within the closure for sealing against the sealing surface of the container, and alignment member in the closure for aligning the sealing member with the sealing surface when the sealing cap is placed over the sealing surface of the container and rotated relative to the sealing surface; and placing the sealing cap over the sealing surface of the container and rotating the sealing cap relative to the container while applying pressure on the sealing cap toward the container so as to cause the alignment member to align radially the sealing member with the sealing surface.

25. The sealing method according to claim 24, wherein the sealing surface is non-circular.

26. The sealing method according to claim 24, wherein said rotating the sealing cap relative to the container while applying pressure on the sealing cap toward the container causes the alignment member to align the sealing member with the sealing surface both radially and axially.

27. A method of sealing the opening of a container through use of a sealing cap which screws on the container and seals against a sealing surface of the container, the sealing surface being non-circular, comprising the steps of providing a sealing cap including a closure and a sealing member arranged within the closure for sealing against the sealing, surface of the container, the sealing member being rotatably movable relative to the closure; aligning the sealing member with the sealing surface; and rotating the closure such that the closure engages the container and applies sealing pressure to the sealing member, the sealing member not rotating relative to the sealing surface as the closure rotates, wherein the sealing cap includes an alignment member arranged within the closure, the sealing member being arranged within the alignment member, wherein the alignment member is rotatably movable relative to the closure and fixed relative to the sealing member, and wherein the step of aligning the sealing surface and the sealing member includes placing the sealing cap over the sealing surface of the container and rotating the sealing cap relative to the container while applying pressure on the sealing cap toward the container so as to cause the alignment member to align radially the sealing member with the sealing surface.

28. The sealing method according to claim 27, wherein, in rotating the closure such that the closure engages the container and applies sealing pressure to the sealing means, the alignment member, as well as the sealing member, does not rotate relative to the sealing surface as the closure rotates.

29. The sealing method according to claim 27, wherein rotating the sealing cap relative to the container while applying pressure on the sealing cap toward the container causes the alignment member to align the sealing member with the sealing surface both radially and axially.

* * * * *